United States Patent [19]

Wang et al.

[11] Patent Number: 4,718,357

[45] Date of Patent: Jan. 12, 1988

[54] MULTI-FUNCTION AUTOMATIC GARBAGE FURNACE

[76] Inventors: Chi-Chen Wang, No.5 Lane 44, Nan Man Road; Chi-Chu Wang, No.149-8 Nan Man Road, both of Tainan, Taiwan

[21] Appl. No.: 1,596

[22] Filed: Jan. 8, 1987

[51] Int. Cl.[4] ..... F23D 14/00; F23G 5/00

[52] U.S. Cl. ..... 110/235; 110/171; 110/210; 110/215; 110/247; 110/258; 110/259

[58] Field of Search ..... 110/235, 247, 259, 171, 110/258, 215, 210, 211, 212

[56] References Cited

U.S. PATENT DOCUMENTS

| | | | |
|---|---|---|---|
| 1,724,352 | 8/1929 | Ilving | 110/247 |
| 3,745,939 | 7/1973 | Allbritton | 110/215 X |
| 3,915,105 | 10/1975 | Michelbrink | 110/171 X |
| 4,203,374 | 5/1980 | Frederick | 110/259 X |
| 4,627,365 | 12/1986 | Tseng | 110/258 X |
| 4,628,829 | 12/1986 | Klaus | 110/235 X |
| 4,633,849 | 1/1987 | Knox | 110/247 X |

*Primary Examiner*—Edward G. Favors
*Attorney, Agent, or Firm*—Armstrong, Nikaido, Marmelstein & Kubovcik

[57] ABSTRACT

This invention concerns about a kind of multi-function automatic garbage furnace which consists of three main divisions; a garbage transporting and storing division, a burning division and a cleaning division of waste gas. The garbage transporting and storing division includes a lifting can, a garbage room, a screw conveyor; the burning division includes a main burning chamber for burning garbage and a rotating bottom net for placing garbage and for dropping ashes, in addition to secondary burning of the waste gas in the secondary burning chamber a leaf wheel, conveyors for; the cleaning division includes a cyclone tank, three sedimentation pools, a clean water pool, leading pipes, a spraying pipe in a spraying room for cleaning the waste gas coming out of the secondary burning chamber by repeated washing and blending before it is released in the open air.

2 Claims, 9 Drawing Figures

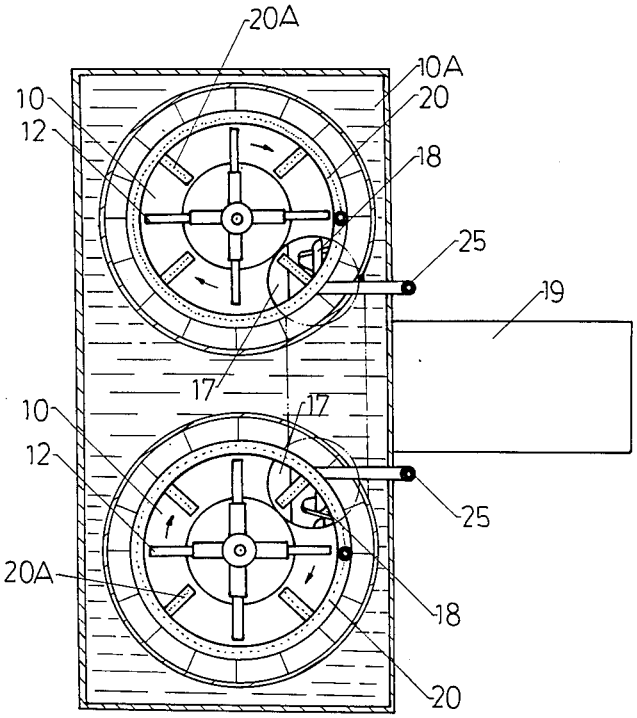
Fig 5 (B-B)
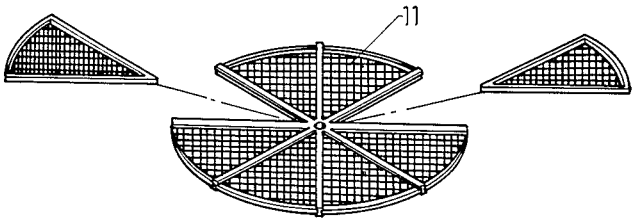
Fig 6

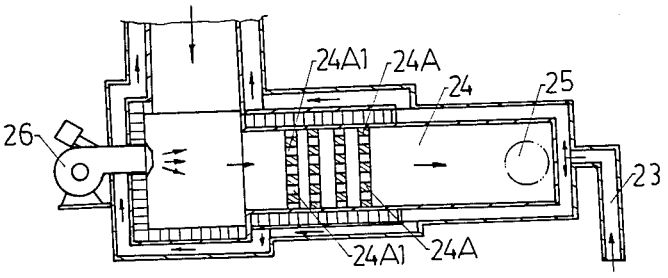
Fig 7 (C-C)
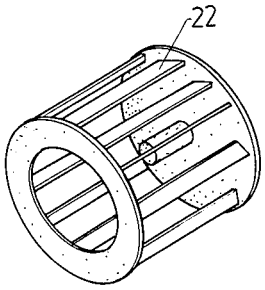
Fig 9 (E)
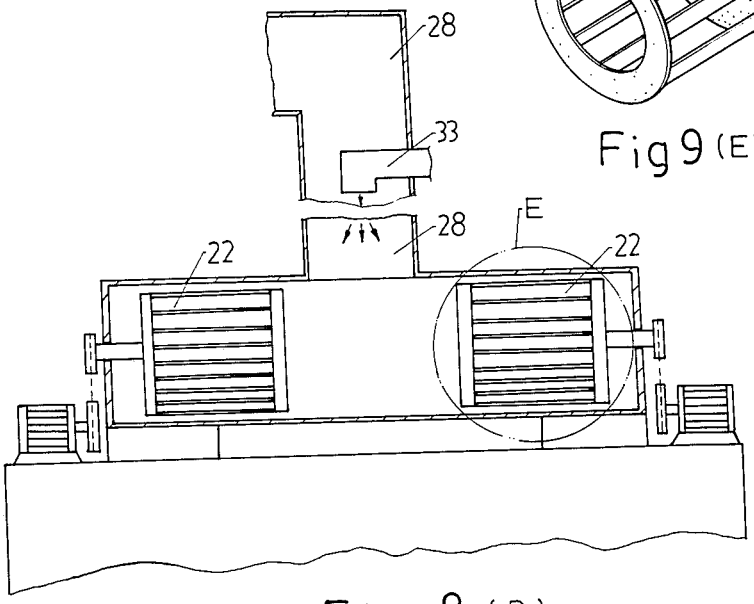
Fig 8 (D)

MULTI-FUNCTION AUTOMATIC GARBAGE FURNACE

BACKGROUND OF THE INVENTION

So far methods for disposing garbage are to pile it up, to discard it in a sea, to burn it up, etc., but the first two methods can give rise to pollution to the environment, water source and harm to fish in the sea. So burning treatment of garbage may be comparatively better not to cause much secondary harm to the public. Nevertheless, burning equipment, large or small, used so far in many countries in the world are not considered to have ideal structures in acquiring perfect burning of garbage or proper treatment of waste gas produced in burning. There are still much pollution and heat pollution in addition to a great deal of expenditure waste in the equipment cost.

SUMMARY OF THE INVENTION

In view of the inffectiveness of garbage furnaces used nowadays, the inventor has worked hard to provide this multi-function automatic garbage furnace.

In this furnace, garbage is burned in a main burning chamber and ashes fall down through a rotating bottom net, being swept by a automatic leaf wheel and then being transported out by a screw conveyor and a belt conveyor.

As for the waste gas produced in burning garbage, it is to be burned once again in a secondary burning chamber; then it receives treatment of repeated washing and cleaning by spraying or immersing in a pool before it is released in the open air.

BRIEF DESCRIPTION OF THE DRAWING

FIG. 5 is a cross-sectional view of B—B line on FIG. 1.

FIG. 6 is a constructional view of the rotating bottom net in this invention.

FIG. 7 is a cross-sectional view of C—C line on FIG. 1, the secondary burning chamber.

FIG. 8 is a diagram of D part on FIG. 1.

FIG. 9 is a diagram of E part on FIG. 8.

DETAILED DESCRIPTION OF THE INVENTION

Figure 1:
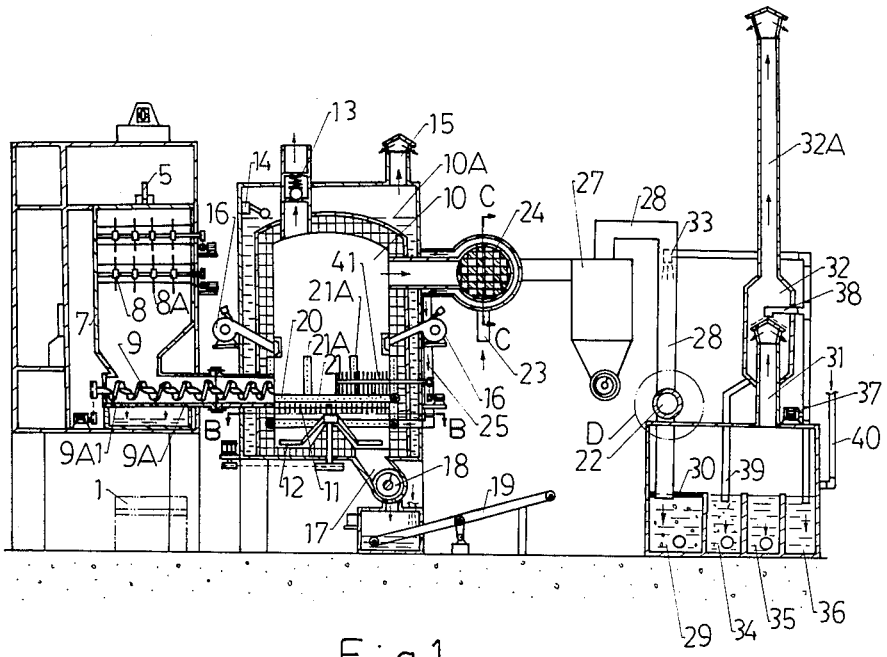
FIG. 1 is a cross-sectional view of this invention.
Figure 2:
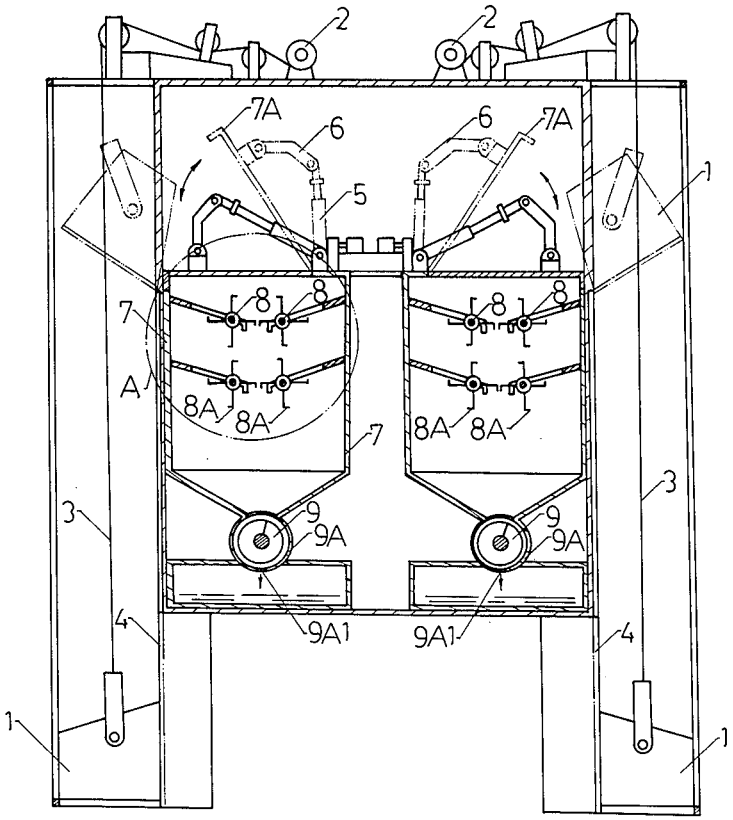
FIG. 2 is a diagram of garbage transporting structure in this invention.

As shown in FIGS. 1,2, lifting can 1 is commonly landed on the ground to receive garbage in and pulled up along rail 4 by which 2 when fully filled up. When lifting can 1 is pulled up to the uppermost and stopped, oil-pressure cylinder 5 forces linking rod 6 to open cover 7A of garbage room 7 and the wire rope continues to pull so as to make lifting can 1 tilted onto the mouth of the garbage room 7 and drop the garbage into garbage room 7.

When the garbage is emptied out, winch 2 is to be operated to keep lifting can 1 move down and oil-pressure cylinder 5 is to pull linking rod 6 back to close cover 7A. The above mentioned operation is repeated again and again to fill garbage room 7 for preparation of burning garbage.

Figure 3A:
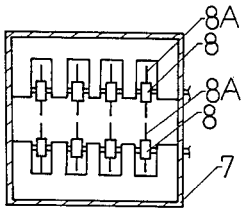
FIG. 3 is a cross-sectional view of A part on FIG. 2, the garbage room.

In FIGS. 1,3, two sets of looseners 8 set in garbage room 7 have their claws rotated inwards to make the garbage put in bags torn out and lossened, and then fall down on screw converyor 9. Bottom wall 9A of screw conveyor 9 is bored with a plurality of sieving holes 9A1 through which water, sand, stone, the non-flammable, etc., in the garbage can fall down before the garbage are sent into main burning chamber 10.

Figure 4:
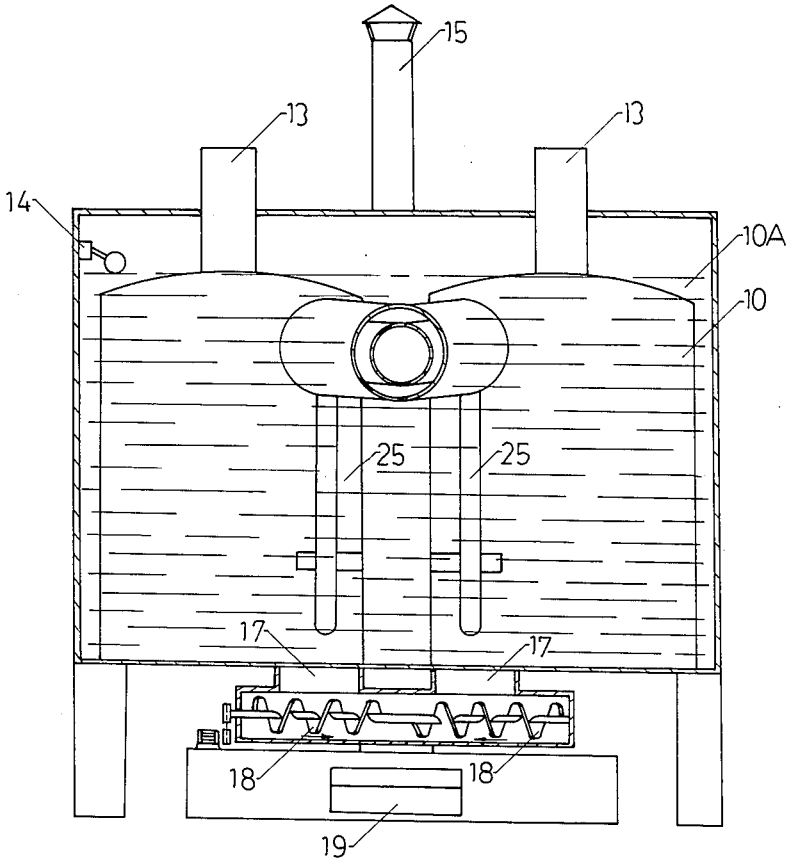
FIG. 4 is cross-sectional view of a partial main burning chamber in this invention.

In FIGS. 1, 4, when the garbage is sent into main burning chamber 10, it will drop onto rotating bottom net 11 which is slowly turned around coaxially with leaf wheel 12 to sweep away ashes. The chamber 10 has a double-partitioned structure; the wall of the inner room is made up of heat-resistant bricks; the outer water room 10A is filled with water which is controlled by float switch 14 and set with steam exit 15 at its top. The top of the chamber 10 is set with a pressure-releasing valve for preventing the danger of the over-heat inflation in the chamber 10. The outer room 10A prevents the heat in the chamber 10 from hurting people. The rotating bottom net 11 consisting of eight pieces as shown in FIG. 6, is to spread the garbage homogeneously on the net 11 and transfer it to the firing area of burner 16 and rake 41 so that the garbage can be homogeneously dired to get burnt easily. Leaf wheel 12, as FIG. 5 also shows, is to sweep the ashes dropping down from the net 11 to slope 17 and the ashes drop down to screw conveyor 18 and then to belt conveyor 19 which can bring them out.

In addition to the burning process with burners 16 and the slow turning around of rotating bottom net 11, air is supplied by ring-shaped air pipe 20 with four branch pipes 20A under rotating bottom net 11 as shown in FIGS. 1,5; all those pipes are bored with a plurality of small air holes closely located. So is set another ring-shaped air pipe 21 with 8 upward branch pipes 21A above rotating bottom net 11; all those pipes are also bored with a plurality of air holes closely located; but 8 branch pipes should be placed near the inner wall of main burning chamber 10, neither hampering the movement of rotating bottom net 11 nor the movement of the garbage on the net 11. The air for ring-shaped air pipes 20,21 and branch air pipes 20A, 21A is sucked in through air entrance pipe 23 by the operation of blowers 22 which suck gas produced in main burning chamber 10, then along the outward wall of secondary burning chamber 24, then through preheating pipe 25, and finally into air pipes 20,21, 20A, 21A; the air which is pre-heated by the hot outward wall of secondary burning chamber 24 flows through pre-heating pipe 25 connected with pipes 20,21 and then flows into main burning chamber 10 to supply enough hydrogen for complete burning of garbage.

As for the burning process, two sets of blowers 22 shown in FIGS. 8,9 sucks the waste gas produced in main burning chamber 10 out into secondary burning chamber 24 shown in FIGS. 1,7. Secondary burning chamber 24 has several honeycomb layers 24A made of heat-resistant bricks which include a plurality of honeycomb holes. The flames shooting out of burner 26 heat up honeycomb layers 24A to red hot, so the waste gas entering secondary burning chamber 24 from main burning chamber 10 flows along as the arrows in FIG. 7 shows, to honeycomb layers 24, then through honeycomb holes 24A gradually slowing down to get enough touching burning so that the poisonous elements in the waste gas can be thoroughly burned up.

The reburned gas coming out of secondary burning chamber 24 is to be sucked into cyclong tank 27 in the direction of a tangent and to form a cyclone current so that comparatively large particles in the gas may fall down through the centrifugal action of the cyclone current, and the gas may be purified a little. Then this gas flows into first sedimentation pool 29 via gas-leading pipe 28, becoming gas bubbles therein; then the impurities in the gas bubbles blend with water, removed from the bubbles, which then go up gradully through sieve 30; the gas cleaned flows into water-spraying room 32 via gas pipe 31, gets washed by spraying-out water therein, and finally flows out in the open air through exit pipe 32A.

Meanwhile, the gas is to be first blended with clean water spraying out of spraying pipe 33 placed in the upper part of gas-leading pipe 28 before it speeds down into first sedimentation pool 29 by the sucking force of blowers 22. When the water in the pool 29 becomes full, it flows out into second and then third sedimentation pools 34,35 and then into clean water pool 36 in turn. All sedimentation pools 29, 34, 35 respedtively have an exit for the dirty water to flow out for purifying treatment. Pump 37 is equipped to suck the clean water out of clean water pool 36, which is to be sprayed out of spraying pipes 33, 38; the water sprayed out of spraying pipe 38 is led into sedimentation pool 34 via water pipe 39 in spraying room 32; the water in the pools 29, 34, 35, 36 can be refilled by supplying pipe 40 if necessary.

The characteristic of this invention is to remove the secondary harm, such as air pollution, heat pollution through several stages of process; one stage is to butn once more the waste gas produced in first burning of garbage to remove poisonous elements in the secondary burning chamber; one stagae is to spray and blend water with the waste gas coming out of cyclone tank 27 and to lead this mixture into sedimentation pool 29 for removing impurities; another stage is to repeat washing and cooling the waste gas before releasing it into the open air.

What is claimed is:

1. A multi-function automatic garbage furnace comprising:

a garbage room for storing garbage which is to be loosened by claws of losseners and to carried into a main burning chamber by a screw conveyor, means for lifting garbage and dropping it into said garbage room, a main burning chamber having a rotating bottom net and a rotating leaf wheel under said bottom net for moving ashes which have fallen through said bottom net to a discharge slope and conveying means, first and second ring-shaped air supply pipes respectively set above and below said rotating bottom net in said main burning chamber, a secondary burning chamber for burning waste gas coming from said main burning chamber, a cyclone tank for separating comparatively large impure particles from the twice-burned waste gas coming from the secondary chamber through centrifugal action, blowers for sucking the waste gas out of the main burning chamber into the secondary burning chamber, and then into said cyclone tank, sedimentation pools for removing other impure particles in the waste gas, and a spraying room to spray clean water into the waste gas coming out of the sedimentation pool for further cleaning action of the gas.

2. A waste gas washing and cleaning system for a multifunction automatic garbage furnace including a garbage room for storing garbage which is be loosened by claws of looseners and to be carried into a main burning chamber by a screw conveyor, means for lifting garbage and dropping it into said garbage room, a main burning chamber and a secondary burning chamber for burning the waste gas from the main burning chamber, comprising;

a cyclone tank for separating comparatively large impure particles from waste gas through centrifugal action, a plurality of sedimentation pools, a clean water pool, a lead pipe extending from said cyclone tank to the first of said sedimentation pools, a first spraying pipe in said lead pipe, a sieve set on the water surface in said first sedimentation pool, a spraying room, a second spraying pipe in said spraying room, a blower for sucking waste gas out of the main burning chamber and delivering said waste gas through said secondary burning chamber, said cyclone tank and said lead pipe to said first sedimentation pool, and an exit pipe from said spraying room whereby said waste gas mixes with water from said first spraying pipe and the mixture flows into said first sedimentation pool where said gas bubbles up through said sieve into said spraying room where said gas is sprayed by said second spraying pipe and flows out of said exit pipe.

* * * * *